United States Patent [19]

Phillips et al.

[11] 4,432,661

[45] Feb. 21, 1984

[54] GEODESIC DOME CONNECTOR

[76] Inventors: Martha E. Phillips, 3906 Ridgecroft Rd., Baltimore, Md. 21206; Leo G. Woerner, 1301 Woodshole Rd., Baltimore, Md. 21204

[21] Appl. No.: 284,197

[22] Filed: Jul. 17, 1981

[51] Int. Cl.[3] ..... F16B 7/00

[52] U.S. Cl. ..... 403/172; 52/80

[58] Field of Search ..... 403/172, 176, 171, 174, 403/178, 170, 175, 177, 173, 217, 219; 52/80, 81

[56] References Cited

U.S. PATENT DOCUMENTS

| | | | |
|---|---|---|---|
| 3,486,278 | 12/1969 | Woods | 52/81 |
| 4,122,646 | 10/1978 | Sapp | 403/171 X |
| 4,260,276 | 4/1981 | Phillips | 403/172 |

FOREIGN PATENT DOCUMENTS

| | | | |
|---|---|---|---|
| 812361 | 8/1951 | Fed. Rep. of Germany | 403/217 |
| 421741 | 8/1974 | U.S.S.R. | 403/174 |

OTHER PUBLICATIONS

Catalog: "Timberline Geodesics Brochure" Timberline Geodesics, 2015 Blake St., Berkley, Calif., 94704, copyright 1981.

*Primary Examiner*—Andrew V. Kundrat

*Attorney, Agent, or Firm*—John F. McClellan, Sr.

[57] ABSTRACT

An improved geodesic dome connector of the paired-opposed-arm type with "swept-back arms", angled axially with respect to the central portion, has a central portion in the form of a cylindrical tube; respective adjacent arms of different pairs join the central portion in close proximity to each other preferably, and preferably also have conical taper on the axial ends of the central member, convex on the outer end and concave on the inner end, for fairing-in sheathing applied on the outer and inner faces by attachment to respective elongate members held between the pairs of arms.

1 Claim, 3 Drawing Figures

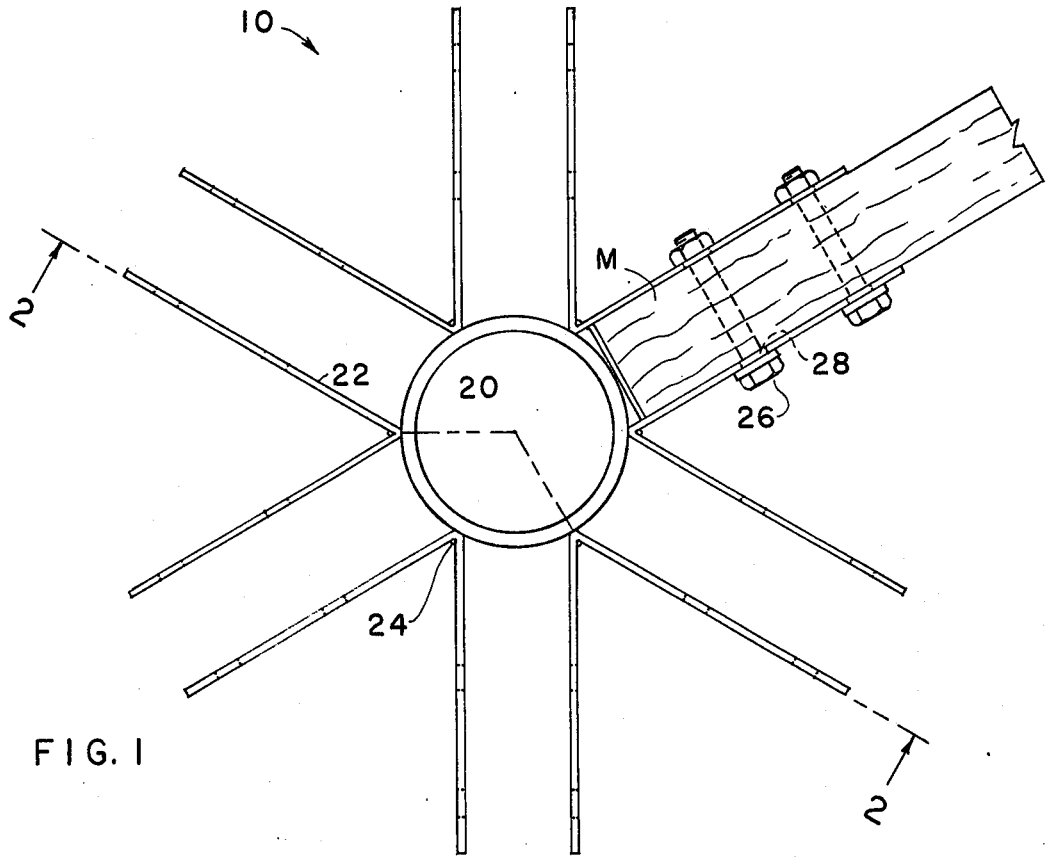
FIG. 1
FIG. 2
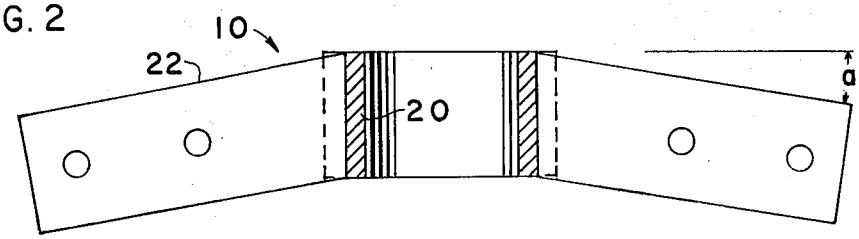
FIG. 3
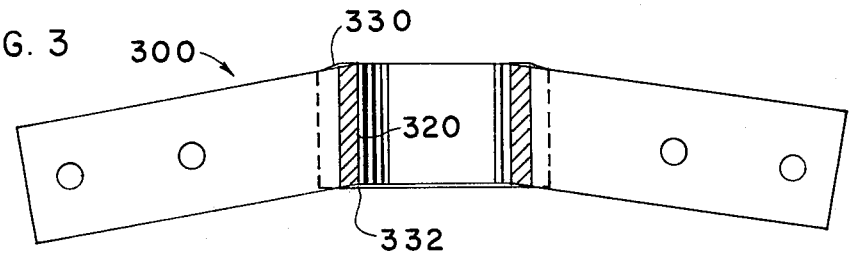

GEODESIC DOME CONNECTOR

FIELD OF THE INVENTION

This invention relates generally to geodesic dome structure and specifically to connectors for such structure.

BACKGROUND OF THE INVENTION

In prior disclosures, various devices for connecting longitudinal members at junctures of a plurality of same have been disclosed, the closest known to the present invention being that of one of the co-inventors, Martha E. Phillips, disclosed in application for U.S. patent Ser. No. 140,854 filed Apr. 16, 1980 for GEODESIC DOME CONNECTOR, issuing as U.S. Pat. No. 4,260,276 on Apr. 7, 1981, the same disclosing truncate-pyramid type polygonal tubular center, each facet of which has a respective pair of parallel-spaced arms extending perpendicularly therefrom for supporting each longitudinal-member end.

The arms originate at the peripheral ends of the facets and are inclined equally and in the same direction relative to the axis of the polygonal tubular center at an angle determined by the size of the geodesic dome. This angle may be called the sweepback angle, and the axial ends of the facets have this angle and are contiguous with the upper and lower edges of the arms. Similarly, the number of pairs of arms is determined by the dome design. Holes through the arms provide for bolt-attachment of the longitudinal members. The connector may be a unitary casting or a weldment.

BRIEF SUMMARY OF THE INVENTION

In the present invention the structure is analogous, but the central portion may be a length of ordinary cylindrical steel pipe, with a preferred-embodiment conical taper at each end, convex on the outer end and concave on the inner end. The taper may be at about the same angle generally as the sweepback of the arms, and the arms sized to fair-in contiguously with the axial ends of the central portion. Without the taper the arms do not fair-in with the central portion and sheathing applied to the outer and inner surfaces is more difficult to fit smoothly. In case the arms have different sweepback angles the taper may approximately fair-in with that of the shallowest sweepback angle at the convex face and of the greatest sweepback angle at the concave face.

OBJECTS OF THE INVENTION

Objects of this invention include those of providing a geodesic dome connector which as a weldment uses as the central portion commercially available tubing and is simpler to weld together in some ways than the polygonal model and which may be more economical, while preserving some of the paired-arm advantages of the polygonal model.

BRIEF DESCRIPTION OF THE DRAWINGS

The above and other objects and advantages of this invention will become more readily apparent on examination of the following description, including the drawings, in which like characters refer to like parts:

FIG. 1 is a fragmentary plan view of the connector in an embodiment with six pairs of arms with an elongate member bolted in place;

FIG. 2 is a partly sectional fragmentary view taken along lines 2—2, in FIG. 1; and FIG. 3 is a fragmentary view similar to that of FIG. 2 but showing an alternative embodiment.

DETAILED DESCRIPTION OF THE DRAWINGS

FIG. 1 shows the invention 10 as comprising a central portion 20 in the form of a cylindrical tube, with six pairs of parallel spaced arms 22 radiating from the central portion to which they join, as by welding.

Each pair of arms is symmetrically disposed along a respective diameter extension of the central portion, and the tube is of a diameter spacing the arms apart circumferentially.

As a preferred feature adjacent arms of different pairs join and brace each other at respective welds on the periphery of the central portion as at 24. This also helps provide room between arms of each pair for the widest possible elongate member M to be secured, as by bolts and nuts 26 through holes 28 in the longitudinal centerline of the arms. The circular configuration not only affords better stress distribution but permits the elongate members to abut it while affording room for a fillet of weld on each side of the junction.

Sheathing is affixed by screws or bolts to the elongate members.

FIG. 2 shows typical elevational-view relations of the design in embodiment 10, between the central portion 20 and the arms 22, which are "swept back" at angle a, and which preferably extend axially the full length of the central portion.

FIG. 3 shows an embodiment 300 in which, preferably, the central portion 320 has at least a conical convex taper 330 at the first, outer, or top axial end as shown, and it may have a similar concave taper 332 at the second, inner, or bottom axial end, for fitting and bracing elongate members.

In either embodiment the connector may be of mild steel, or of stainless steel.

The central portion may in representative embodiment be about $3\frac{1}{2}$ inches (8.7 cm) in outside diameter, with a 7/32 inch (5 mm) wall thickness and may be 2 inches (5 cm) long. The arms may be about 3/32 inch (2.3 mm) thick, 5 inches (13 cm) long and 1 15/16 inch (4.9 cm) wide. Two holes of 17/32 inch (1.4 cm) diameter may be supplied in the long centerline of the arm, respectively 2 3/16 inches (6.2 cm) and $4\frac{3}{8}$ inches (11.2 cm) from the welded junction with the central portion along the long centerline.

Angle a in typical embodiment may be 10°; this may vary from pair to pair according to geodesic dome assembly requirements.

The elongate members for use with this connector may be $1\frac{5}{8}$ inch (4.1 cm) by 2 inches in section.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a connector for geodesic domes, having a plurality of pairs of arms radiating from a central tubular portion, each pair of arms in symmetrically parallel-spaced relation about a respective radius of the central portion, and at an axial angle thereto, and having holes in the arms for bolted connection of a respective elongate member between each pair of arms; the connector having a first or outer face and a second or inner face, the improvement comprising: the central tubular portion being a cylindrical tubular member, respective adjacent arms of different pairs being affixed at a respective junction with each other at the perimeter of the central portion, the central tubular portion having a conical convex taper on the axial end thereof at said outer face; and the central tubular portion having a conical concave taper on the axial end thereof at said inner face.

* * * * *